United States Patent [19]

Mesmer et al.

[11] Patent Number: 4,563,187

[45] Date of Patent: Jan. 7, 1986

[54] COMPOSITION FOR CLEANING TEXTILE SURFACES

[75] Inventors: Otto Mesmer, Wuppertal; Wolfgang Polligkeit, Schwelm; Wolfgang Tröger, Pulheim; Andreas Wolter, Wuppertal, all of Fed. Rep. of Germany

[73] Assignee: Vorwerk & Co. Interholding GmbH, Wuppertal, Fed. Rep. of Germany

[21] Appl. No.: 579,859

[22] Filed: Feb. 13, 1984

[30] Foreign Application Priority Data

Feb. 12, 1983 [DE] Fed. Rep. of Germany ..... 3304887

[51] Int. Cl.[4] ..... C11D 17/06; C11D 3/37

[52] U.S. Cl. ..... 8/137; 252/88; 252/89.1; 252/173; 252/174.13

[58] Field of Search ..... 8/137; 252/89.1, 174.13, 252/88

[56] References Cited

U.S. PATENT DOCUMENTS

| | | | |
|---|---|---|---|
| 3,853,989 | 12/1974 | Conn et al. | 252/9 D |
| 3,910,848 | 10/1975 | Froehlich et al. | 252/9 D |
| 3,979,339 | 9/1976 | Claybaush | 252/135 |
| 4,440,661 | 4/1984 | Takeuchi et al. | 252/89.1 |

FOREIGN PATENT DOCUMENTS

| | | |
|---|---|---|
| 855362 | 10/1977 | Belgium . |
| 86968 | 8/1983 | European Pat. Off. . |
| 2118820 | 11/1972 | Fed. Rep. of Germany . |
| 2544605 | 4/1976 | Fed. Rep. of Germany . |
| 54-50675 | 4/1979 | Japan . |
| 2001099 | 1/1979 | United Kingdom . |

*Primary Examiner*—A. Lionel Clingman
*Attorney, Agent, or Firm*—Michael J. Striker

[57] ABSTRACT

A cleaning means is disclosed for textile surfaces, particularly textile floor coverings, containing a powdery, porous carrier material based upon urea-formaldehyde-resin foam which is enriched with cleaning agent, whereby the tenside-containing water adhered within the carrier material from the foaming-up process is stored completely homogeneously in the carrier material, and forms together with the cleaning agent the prepared product. It is suggested for lowering the free formaldehyde content, to add to the tenside-containing water adhering within the carrier material, a salt of sulfurous acid in an effective portion, relative to the anion of the acid, from 0.01–2% by weight. This strongly reduces the portion of free formaldehyde and adjusts the pH-value of the cleaning means between 6 and 9.

3 Claims, No Drawings

COMPOSITION FOR CLEANING TEXTILE SURFACES

BACKGROUND OF THE INVENTION

The invention concerns a cleaning agent for textile surfaces, particularly textile floor coverings, which is composed substantially of a powdery, porous carrier material, whereby the carrier material is composed of plasticized urea-formaldehyde-resin foam and enriched with cleaning agent. The prepared, packaged product displays, with regard to the carrier material, a density of 20–60 kg/m$^3$, as well as a bulk density of 50–150 g/liter, and a grain size of the carrier material of from 0.01 to 12 mm. The tenside-containing water adhering within the carrier material in an amount of max. 80% by weight relative to the weight of the carrier material, is stored completely uniformly in the carrier material. The cleaning agent is provided from the mixture of carrier material with an aqueous solution, which contains 0.01–0.5% by weight of an antistatic agent promoting the ability to withdraw the cleaning composition from the applied surface by suction and 0.01–2% by weight of a volatile alkali, as well as 0.5–5% by weight of a polymer-tenside combination which restrains re-soiling of the applied surface.

Such cleaning agents are known, and serve the purpose of being sprinkled, powder-like, onto the textile surfaces, to clean the textile fibers, and then, with the loosened, withdrawn dirt, of being removed again from the textile surfaces after a drying period.

There is known, e.g., from DE-PS No. 27 32 011, a tenside-containing cleaning agent of the described type, with which the free formaldehyde content adhering within the carrier material is supposed to be bound off i.e. reacted as extensively as possible by means of a volatile alkali. Such a solution has the disadvantage that the formaldehyde-binding mechanism of the following formula:

$$6CH_2(OH)_2+4NH_3=(CH_2)_6N_4+12H_2O$$

(wherein $(CH_2)_6N_4 \hat{=}$ Urotropin),
runs disadvantageously, in that the water adhering within the cleaning agent disturbs the formation of the urotropin on the right side of the equation, but in the desired pH-value range, a disturbing portion of free formaldehyde remains present.

It is furthermore known to decrease the formaldehyde development from aminoplastic foam materials, by treating the prepared foam material at the surface, with a non-volatile, formaldehyde-binding agent, containing an aqueous mixture of urea, ammonia, ammonium sulfate and a hygroscopic agent.

Herewith it is disadvantageous that the water-attracting or water-holding agent can find no use with regard to a floor-cleaning agent of the type according to the invention, since this lengthens the drying period to a considerable extent and substantially impairs the ability to withdraw by suction.

SUMMARY OF THE INVENTION

It is therefore the object of the present invention—while avoiding the mentioned shortcomings—to provide a cleaning agent, with which the free formaldehyde is loosened as extensively as possible, under simultaneous, automatic boosting and stabilization of the pH-value.

This object is attained according to the present invention by means of, in the tenside-containing water adhering within the carrier material, which displays a pH-value of <4 as well as a free formaldehyde content of max. 0.20% by weight, salts of sulphurous acid in an effective amount relative to the anion of the acid of 0.01–2.0% by weight, and by simultaneously adding to the cleaning agent 0.01–2% by weight of ammonia, as well as adjusting the pH-value of the cleaning agent between 6 and 9.

It is, moreover, essential to the invention that 0.1–5% by weight urea is added to the cleaning agent, and that 0.01–2% by weight thiosulfate is allotted to the cleaning agent.

As proceeds from the mentioned equation $6CH_2(OH)_2+4NH_3=(CH_2)_6N_4+12H_2O$, urotropin and water are formed. On account of the condition of equilibrium, the formaldehyde is not widely sufficiently loosened. One proceeds with salts of sulphurous acid, e.g. $SO_3^{-2}$, $HSO_3^{-2}$ and/or thiosulfate $S_2O_3^{-2}$, to form hydroxymethane-sulfonate—or similar product $S_2O_3^{-2}$—and simultaneously the base $OH^-$, which has a neutralizing effect as hydronium ion receiver.

Relative to the sulfite, the following equation is provided:

$$CH_2(OH)_2+SO_3^{-2}=HO—CH_2—SO_3^-+OH^-.$$

The condition of equilibrium is pH-dependent. In neutral milieu, the sulfite ions attack preferably the monomeric and polymeric free formaldehyde as well as the formaldehyde bound semi-acetal-like on N-methylol groups. Under acid and basic catalyzed conditions, however, also the labile formaldehyde bound on N-methylol groups is loosened by means of $SO_3^{-2}$.

The solution according to the invention possesses the advantage that through the as extensive as possible lowering of the free formaldehyde, a toxicologically and dermatologically generally unharmful cleaning agent is provided. A further advantage of the invention is that through the adjustment of the pH-value, the textile surface structure to be cleaned, with very good cleaning force, is in no way injured. In other respects, a technical/production advantage is obtained, and therewith an environmentally favorable, economical commodity is made available to the consumer.

The novel features which are considered as characteristic for the invention are set forth in particular in the appended claims. The invention itself, however, both as to its construction and its method of operation, together with additional objects and advantages thereof, will be best understood from the following description of specific embodiments.

DESCRIPTION OF THE PREFERRED EMBODIMENTS

In the following Examples, one proceeds with 12.5% by weight urea-formaldehyde-resin foam, and the given starting solutions.

The results are set forth in the table:

EXAMPLE 1

| | |
|---|---|
| 79.83% by weight | Water |
| 0.20% by weight | De-foamer |
| 0.15% by weight | Antistatic agent |

-continued

| | |
|---|---|
| 1.20% by weight | Tenside polymer and Bactericide |
| 0.10% by weight | Perfume oil |
| 5.00% by weight | Low molecular alcohol |
| 0.57% by weight | $NH_3$—solution (25%) |
| 0.45% by weight | $SO_3^{-2}$ |

EXAMPLE 2

| | |
|---|---|
| 77.40% by weight | Water |
| 0.20% by weight | De-foamer |
| 0.15% by weight | Antistatic agent |
| 1.20% by weight | Tenside polymer and Bactericide |
| 0.10% by weight | Perfume oil |
| 5.00% by weight | Low molecular alcohol |
| 0.41% by weight | $NH_3$—solution (25%) |
| 2.63% by weight | Urea |
| 0.41% by weight | $SO_3^{-2}$ |

EXAMPLE 3

| | |
|---|---|
| 77.35% by weight | Water |
| 0.20% by weight | De-foamer |
| 0.15% by weight | Antistatic agent |
| 1.20% by weight | Tenside polymer and Bactericide |
| 0.10% by weight | Perfume oil |
| 5.00% by weight | Low molecular alochol |
| 0.35% by weight | $NH_3$—solution (25%) |
| 0.41% by weight | $SO_3^{-2}$ |
| 2.60% by weight | Urea |
| 0.14% by weight | Thiourea* |

(*In this Example, thiourea can be used as a substitute for thiosulfate and/or urea.)

EXAMPLE 4

| | |
|---|---|
| 77.16% by weight | Water |
| 0.20% by weight | De-foamer |
| 0.15% by weight | Antistatic agent |
| 1.20% by weight | Tenside polymer and Bactericide |
| 0.10% by weight | Perfume oil |
| 5.00% by weight | Low molecular alcohol |
| 0.43% by weight | $NH_3$—solution (25%) |
| 2.65% by weight | Urea |
| 0.41% by weight | $SO_3^{-2}$ |
| 0.20% by weight | $S_2O_3^{-2}$ |

TABLE OF RESULTS

| Agent | pH-Value | mg Formaldehyde | % |
|---|---|---|---|
| Cleaner without additive | 3.0 | 65 mg/50 gr. mat. | 100% |
| Cleaner + $NH_3$ | 8.4 | 10.7 mg/50 gr. mat. | 16.5% |
| Example 1 | 8.1 | 4.0 mg/50 gr. mat. | 6.2% |
| Example 2 | 8.1 | 1.7 mg/50 gr. mat. | 2.6% |
| Example 3 | 7.0 | 1.2 mg/50 gr. mat. | 1.9% |
| Example 4 | 7.2 | 1.0 mg/50 gr. mat. | 1.5% |

It is recognizable from the Examples, that the free formaldehyde is lowered below the permissible limits, with simultaneous stabilization of the pH-value.

It will be understood that each of the elements described above, or two or more together, may also find a useful application in other types of cleaning agents differing from the types described above.

While the invention has been illustrated and described as embodied in a cleaning agent for textile surfaces, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications withour omitting features that, from the standpoint of the prior art, fairly constitute essential characteristics of the generic or specific aspects of this invention.

We claim:

1. A cleaning composition for textile surfaces, including textile floor coverings, which comprises:

(a) a porous, powdery carrier material of urea-formaldehyde resin foam, said carrier material prepared by comminuting a urea-formaldehyde foam having a density of 20 to 60 kg/m$^3$ into particles of 0.01 to 12 mm, and having a bulk density of 50 to 150 g/l, and (b) a tenside-containing aqueous solution adhering within said comminuted carrier material, stored uniformly in said comminuted carrier material, and having a maximum resulting formaldehyde content of 0.20%, which contains:

(i) 0.01 to 0.5% by weight of an antistatic agent promoting the ability to withdraw the composition from an applied surface by suction;

(ii) 0.01 to 2% by weight of ammonia;

(iii) 0.05 to 5% by weight of a polymer-tenside which prevents resoiling of the applied surface;

(iv) 0.1 to 5% by weight of urea;

(v) 0.01 to 2% by weight thiosulfate;

(vi) 0.01 to 2% by weight of sulfite ion provided by a salt of sulfurous acid capable of converting free formaldehyde associated with the comminuted carrier material into a hydroxy-methane sulfonate salt as well as liberating hydroxide ion, so that the pH of the tenside-containing aqueous solution is adjusted to a level of 6 to 9; and (vii) balance water.

2. The cleaning composition defined in claim 1 wherein the porous, powdery carrier makes up about 12.5% by weight of the composition and the tenside-containing aqueous solution makes up the balance.

3. The cleaning composition defined in claim 1 wherein the porous, powdery carrier makes up about 12.5% by weight of the composition and the tenside-containing aqueous solution makes up the balance.

* * * * *